United States Patent [19]

Balakrishnan et al.

[11] 4,177,068

[45] Dec. 4, 1979

[54] EXTRACTION OF GOLD AND SILVER

[75] Inventors: Ramachandran Balakrishnan, Reading; Geoffrey F. Skinner, Maidenhead, both of England

[73] Assignee: Foster Wheeler Energy Corporation, Livingston, N.J.

[21] Appl. No.: 881,335

[22] Filed: Feb. 27, 1978

[30] Foreign Application Priority Data

Mar. 4, 1977 [GB] United Kingdom ..... 9230/77

[51] Int. Cl.[2] ..... C22B 11/08

[52] U.S. Cl. ..... 75/105; 75/101 R; 75/106; 75/107; 75/118 R; 204/109; 204/110; 423/28; 423/29; 423/32

[58] Field of Search ..... 75/101 R, 105, 106, 75/107, 118 R; 204/109, 110; 423/28, 29, 32

[56] References Cited

U.S. PATENT DOCUMENTS

| | | | |
|---|---|---|---|
| 683,325 | 9/1901 | Phillips | 75/118 R |
| 1,103,346 | 7/1914 | Butters | 75/118 R |
| 2,112,299 | 3/1938 | Mills et al. | 75/107 X |
| 2,131,535 | 9/1938 | Hedley | 75/105 |
| 2,304,427 | 12/1942 | Sibley | 75/118 P X |
| 3,709,680 | 1/1973 | Holmes et al. | 75/118 R |
| 3,777,004 | 12/1973 | Lankenau et al. | 75/118 R X |
| 3,808,306 | 4/1974 | Smith et al. | 75/101 R X |
| 4,017,309 | 4/1977 | Johnson | 75/117 X |
| 4,070,182 | 1/1978 | Genik-Sas-Berezowsky et al. | 75/103 |
| 4,072,587 | 2/1978 | Heinen et al. | 204/110 |

*Primary Examiner*—G. Ozaki

*Attorney, Agent, or Firm*—Marvin A. Naigur; John E. Wilson; John J. Herguth, Jr.

[57] ABSTRACT

A process for the extraction of gold and silver from their ores in which the ore is reduced to a particle size of 1 mm or less and mixed with a lixiviant, e.g., alkaline sodium or potassium cyanide, in an amount to provide a liquor content of about 8 to 12%, the lixiviant coated particles are allowed to react for a time sufficient for the lixiviant to extract the noble metal and the particles washed with water to obtain a solution of the noble metal salt from which the noble metal is recovered.

8 Claims, 2 Drawing Figures

EXTRACTION OF GOLD AND SILVER

This invention relates to the extraction of gold and of silver.

BACKGROUND TO THE INVENTION

Gold and silver are usually extracted from their ores by a leaching process. The ores may be specifically mined for their gold or silver content, or the metals may be obtained as by-products when the base metals such as lead, zinc and copper are refined.

The auriferous ore undergoes a primary and secondary crushing to size of about 3 mm. This is followed by a fine grinding, for example in a ball mill to a particle size of about −0.074 mm (−200 mesh). The lixiviant is mixed with the ore during and/or after fine grinding. Suitable lixiviants for the extraction of gold, include dilute alkaline solutions of sodium cyanide and potassium cyanide. Alkaline cyanide solutions are the preferred lixiviants in the current commercial practice.

The cyanide solution is used in dilute form, for example 0.025% by weight, with protective alkalinity e.g. by the addition of lime, and is added in an amount to give a slurry generally having about 40 to 50% by weight solids content. This slurry is held in air-agitated pachuca tanks for periods up to 50 hours to achieve maximum extraction of gold. The gold present in the ore reacts with the cyanide solution to yield the water soluble complex. If sodium cyanide is used as the lixiviant $Na(Au(CN)_2)$ is formed. The suspension is agitated with compressed air during the extraction.

The solution of the gold compound is then filtered and de-aerated, for example, under vacuum to remove the dissolved air. The metal is then recovered from solution by zinc cementation or by electrolysis. In the case of zinc cementation a suspension of finely powdered zinc dust is added to the solution and the gold precipitated and separated by further purification.

In the case of the extraction of silver with cyanide solution a reaction occurs between free silver and, for example, the silver sulphide present in argentite, and the cyanide solution to yield the water soluble argentocyanide e.g. $Na(Ag(CN)_2)$ and the slurry is agitated with compressed air. The recovery of the metal from the silver containing solutions is achieved in a similar manner to that of gold.

The above process suffers from the following disadvantages. The ore must be ground to a fine particle size which is both expensive and time consuming. The slurry leach process may take several hours to extract the metal and the filtration of the resulting gold bearing solution may be arduous due to the fine particle size of the filtered solids.

The present invention has been made with the above points in mind.

SUMMARY OF THE INVENTION

According to the present invention there is provided a process for the extraction of gold and/or silver, from their ores in which the ore is ground to a particle size of the order of 1 mm or less and the particles thoroughly mixed with a suitable lixiviant for the metal in an amount such that mixture retains from the free-flowing solid properties characteristic of the unwetted particles, the concentration and the amount of lixiviant being sufficient to solubilize all of the gold and/or silver from the ore and any of other lixiviant consuming materials present, the mixture is allowed to react for a time sufficient for the lixiviant to extract the gold or silver and the particles washed with water to obtain a solution of the gold and/or silver salts which is treated to recover the gold and/or silver.

The invention provides a process for extracting gold or silver which allows considerable saving in grinding costs and also simplifies the solid-liquid separation duties as compared with prior art extraction procedures. Also the residues of the invention are more readily disposable. The ore is ground to a particle size of the order of 1 mm or less and mixed with lixiviant. If particle sizes of greater than 1 mm are used the efficiency of the extraction is impaired and the extraction times are increased beyond economic viability. The process is applicable to particle sizes of 1 mm or less. The lixiviant is used as a fairly concentrated solution and added in an amount so that the mixture retains the free flowing properties characteristic of the unwetted particles—i.e., the mixture is not of pasty consistency or in suspension, but each particle is coated with a film of lixiviant. The liquor content of such a mixture is generally of the order of 8 to 12% and more particularly 10% by weight. The concentration of lixiviant is higher than those of the prior art for example, 0.10 to 5% by weight, generally 0.25 to 2% by weight. The lixiviant may conveniently be sprayed onto ore followed by mixing in a rotary vessel, to ensure efficient and uniform distribution. Alternatively, the lixiviant may be included during grinding e.g. in a rod-mill.

The resulting mixture is allowed to react in a bed—e.g a static bed. When a cyanide solution is the lixiviant it is essential that the bed is kept well-aerated. For faster rates of extraction an atmosphere of oxygen is provided. The reaction period varies according to the conditions and the nature of ore being treated but may be of the order of 12 to 48 hours when the bed is maintained at a temperature from 10° C. to 40° C. We have found that efficient extractions of gold from gold bearing ores may be achieved at temperatures from 15° C. to 30° C. through the range up to 40° C. especially within the range 25° C. to 28° C.

After the reaction period the bed is washed, for example, by reslurrying with water or by percolation. Percolation washing is simple and water is merely passed through the static bed and the "pregnant" liquor collected. Washing to produce the gold bearing leach solution may also be carried out on vacuum rotary drum or belt filters. The filtration duties are light due to the large particle size.

The resulting solution of gold (or silver) is de-aerated and the metal recovered by cementation. Alternatively the metal may be recovered electrolytically.

The preferred lixiviants for use in the invention are alkaline solutions of sodium or potassium cyanide.

The invention is further illustrated by the accompanying drawings in which.

DESCRIPTION OF PREFERRED EMBODIMENTS

Presently preferred process for the extraction of gold comprises the steps of:

(a) Grinding gold containing ore to a particle size of the order of 1 mm.

(b) Mixing the particles or ore with alkaline potassium or sodium cyanide solution at a concentration of 0.25 to 2% by weight in an amount such that the liquor content of the mixture is of the order of 10% by weight.

(c) Reacting the mixture in a well-aerated static bed or a bed held in atmosphere of gaseous oxygen at ambient temperature of for a period of 12 to 40 hours.

(d) Washing the reacted mixture with water to yield a solution of aurocyanide.

(e) Treating the solution to separate the gold.

Figure 1:
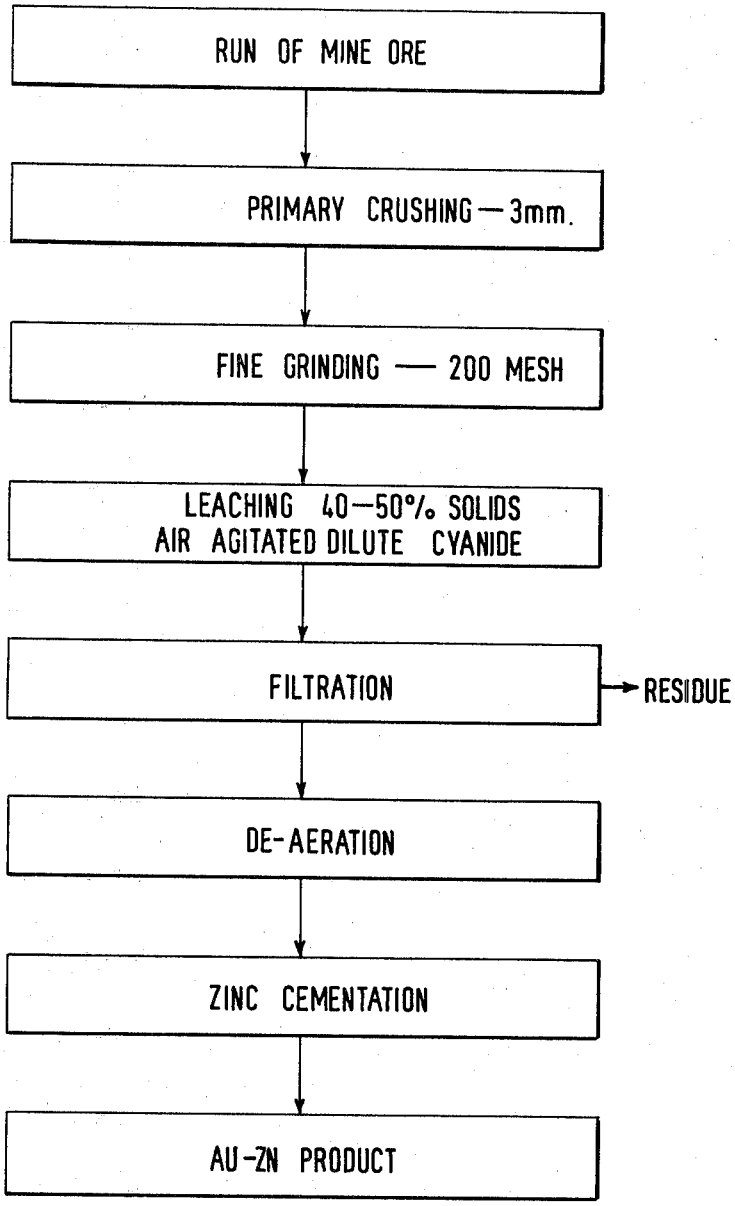
FIG. 1 represents a flow diagram of an extraction process of the prior art.
Figure 2:
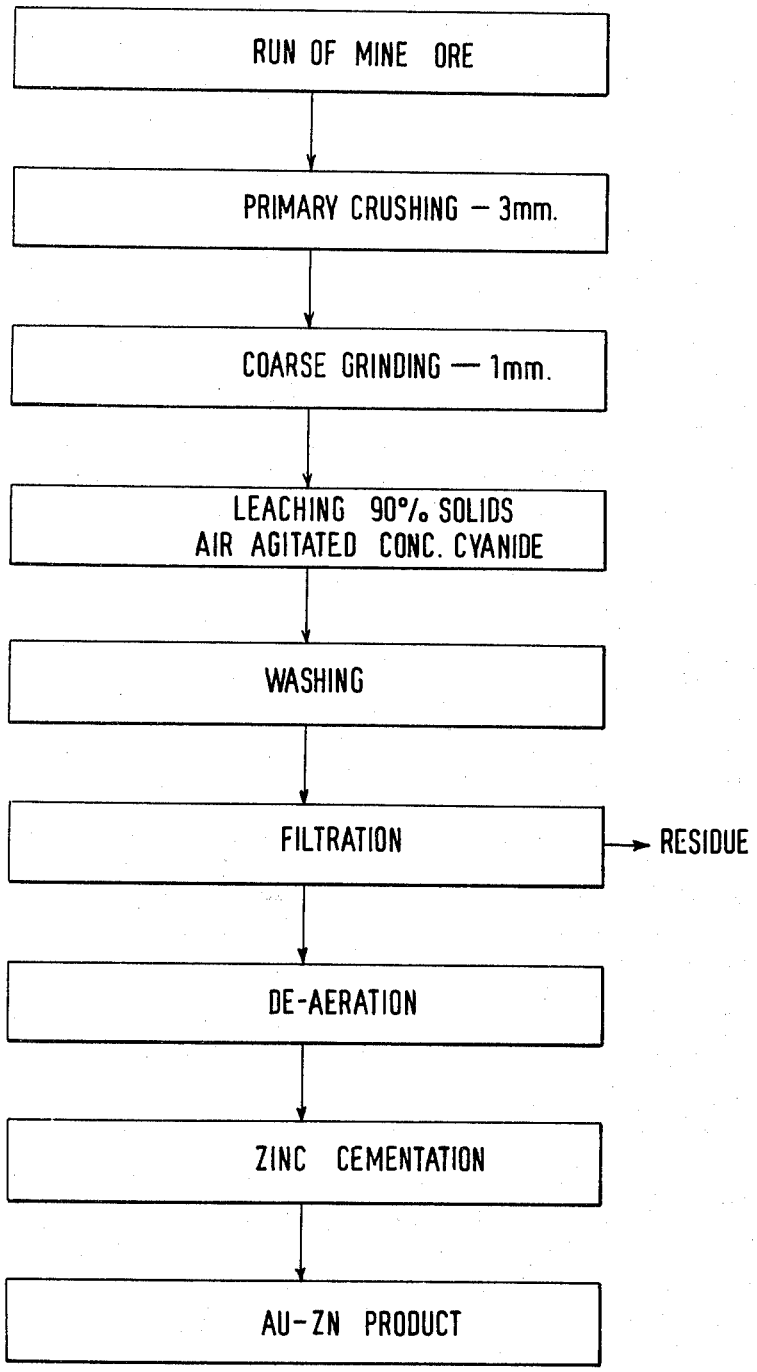
FIG. 2 represents a flow diagram of an extraction process according to the invention.

The process of the invention shown in the flow diagram of FIG. 2 requires only coarse grinding of the ore and utilises a small amount of concentrated leaching solution. The process might be performed using the existing prior art equipment without any substantial modification.

The invention shown in the flow diagram of FIG. 2 will now be illustrated with reference to the following Examples.

EXAMPLE 1

Auriferous quartzitic material of South African origin having a head grade of 15.0 g of Au/ton was used.

200 g of auriferous material having a particle size of 1-mm was thoroughly mixed with 22 g of 0.5% NaCN solution. The cyanide solution was saturated with analar $Ca(OH)_2$ to provide protective alkalinity during cyanidation. The mixture was charged into a glass column and an oxygen atmosphere was provided by passing 150 ml/min. of oxygen. After 16 hours at the ambient temperature of 16° C., the mixture was taken out of the glass column and washed with 230 ml. of water. The liquid was filtered and analysed for gold by atomic absorption. The solution assayed 12 mg/l of gold, giving a gold extraction of 99.6%.

EXAMPLE 2

Auriferous quartzitic material of South African origin having a head grade of 10.5 g of Au/ton was used.

400 g of auriferous material having a particle size of 0.6 mm was mixed thoroughly with 44 g of 0.5% solution of NaCN, and was charged into a glass column and held in an atmosphere of oxygen at 25° C. for 17 hours. The reacted mixture was washed on Buchner with 500 ml of water. The wash solution analysed 8.2 mg/l of gold, giving an extraction of 99.04%.

EXAMPLE 3

Auriferous quartzitic material of South African origin having a head grade of 14.6 g of Au/ton was used.

200 g of auriferous material having a particle size of 1-mm was thoroughly mixed with 22 g of 0.5% NaCN solution. The cyanide solution was saturated with analar $Ca(OH)_2$ to provide protective alkalinity during cyanidation. The mixture was charged into a glass column and an oxygen atmosphere was provided by passing 150 ml/min. of oxygen. After 22 hours at the ambient temperature of 16° C., the mixture was taken out of the glass column and washed with 220 ml. of water. The liquid was filtered and analysed for gold by atomic absorption. The solution assayed 13 mg/l of gold, giving a gold extraction of 97.95%.

EXAMPLE 4

Auriferous quartzitic material of South African origin having a head grade of 9.23 g of Au/ton was used.

500 g of auriferous material having a particle size of 0.6 mm was mixed thoroughly with 68 g of water, 0.7 g NaCN and 2 g of analar $Ca(OH)_2$ and was charged into a glass column and held in an atmosphere of oxygen at 25° C. for 40 hours. The reacted mixture was slurried with 1 liter of water and filtered on a Buchner funnel. The solution analysed 5.6 mg/l of gold. The solid residue was assayed for gold and was found to contain 0.65 g of Au/ton giving a gold extraction of 93.0%.

EXAMPLE 5

This example illustrates the feasibility of the process of the invention on a tailings dump of old gold workings in South Africa. The material is basically of −100 mesh (−0.15 mm).

1 Kg of the dump material assaying 0.56 g of Au/ton was mixed with 1 g of NaCN 3 g of $Ca(OH)_2$ and 88 ml of water and charged into a glass column. An oxygen atmosphere was provided, and the mixture was allowed to react for 22 hours at 18° C. (ambient temperature). The reacted mix was displacement washed on a Buchner funnel with 400 ml of water, and the liquor was assayed for Au by Atomic Absorption.

The solution analysed 0.8 g/l of Au giving a gold extraction of 57.1%. The residue was dried, was assayed to contain 0.24 g/ton of Au, thus confirming the above extraction.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

What is claimed is:

1. A process for the extraction of a noble metal selected from the group consisting of gold and silver from their respective ores comprising the steps of:

(a) reducing said ore to a particle size of about 1 mm or less, (b) mixing said particles with an alkaline solution having a concentration of from 0.10 to 5% by weight of lixiviant for said noble metal such lixiviant selected from the group consisting of sodium cyanide and potassium cyanide in an amount to provide a liquor content of from 8 to 12% by weight of the mixture of lixiviant and ore, the concentration of said lixiviant being sufficient to solubilize all said noble metal in the ore and any other lixiviant consuming materials present, (c) allowing the mixture from step (b) to react in a static bed at a temperature of 10° to 40° C. for a period between 12 and 48 hours and sufficient for the lixiviant to extract said noble metal, while said bed is being aerated, (d) reslurrying said bed with water, and (e) filtering the solution from step (d) to recover said metal.

2. A process according to claim 1 wherein said noble metal is gold.

3. A process according to claim 2 wherein the lixiviant is present in an amount to provide a liquor content of about 10% by weight of the mixture of lixiviant and ore.

4. A process according to claim 2 wherein step (a) and step (b) are performed simultaneously.

5. A process according to claim 2 wherein said solution has a concentration of 0.25 to 2% by weight.

6. A process according to claim 2 wherein said noble metal is recovered from solution by zinc cementation.

7. A process according to claim 2 wherein said noble metal is recovered from solution by electrolysis.

8. The process defined in claim 1 wherein said noble metal is gold, said ore is an auriferous ore, said ore is reduced to a particle size of the order of 1 mm, said lixiviant is sodium cyanide, said solution is at a concentration of 0.25 to 2% by weight and the liquor content of the mixture of lixiviant and ore is approximately 10% by weight.

* * * * *